United States Patent [19]

Satomi et al.

[11] 4,286,865

[45] Sep. 1, 1981

[54] ELECTROPHOTOGRAPHIC COPYING APPARATUS FOR THE PRODUCTION OF MULTIPLE COPIES FROM A SINGLE LATENT ELECTROSTATIC IMAGE

[75] Inventors: Toyokazu Satomi; Mitsuru Ohminato, both of Yokohama; Yasuhiro Tabata, Kawasaki, all of Japan

[73] Assignee: Ricoh Company, Ltd., Tokyo, Japan

[21] Appl. No.: 72,453

[22] Filed: Sep. 4, 1979

Related U.S. Application Data

[63] Continuation-in-part of Ser. No. 835,416, Sep. 27, 1977.

[30] Foreign Application Priority Data

Sep. 29, 1976 [JP] Japan ..... 51/116900
Dec. 28, 1976 [JP] Japan ..... 51/157815

[51] Int. Cl.[3] ..... G03G 15/00
[52] U.S. Cl. ..... 355/14 CU; 355/3 R
[58] Field of Search ..... 355/14 R, 3 R, 14 CU, 355/14 C, 3 SC; 430/54

[56] References Cited

U.S. PATENT DOCUMENTS

Re. 29,179 4/1977 Davidge et al. ..... 355/14 R
4,142,792 3/1979 Satomi et al. ..... 355/14 R

*Primary Examiner*—R. L. Moses
*Attorney, Agent, or Firm*—Wyatt, Gerber, Shoup, Scobey & Badie

[57] ABSTRACT

An improved electrophotographic copying apparatus is described, which permits, during automatic copying of a desired number of copies from the same original document, the setting of the number of repeated uses of the same latent electrostatic image, thus obviating the lowering and unevenness of image quality of the copies. In another embodiment of the improved electrophotographic copying apparatus, the timing of the formation of successive latent images of the same original document is controlled in accordance with the total number of copies to be made of the same original document so that the number of repeated uses of each respective latent image is made approximately equal. Also, in the latter embodiment, a signal indicating the timing for the exchange of successive original documents is generated at the time of formation of the last electrostatic image from the prior original document.

15 Claims, 7 Drawing Figures

ELECTROPHOTOGRAPHIC COPYING APPARATUS FOR THE PRODUCTION OF MULTIPLE COPIES FROM A SINGLE LATENT ELECTROSTATIC IMAGE

This application is a continuation in part of Ser. No. 835,416, filed Sept. 27, 1977.

BACKGROUND OF THE INVENTION

This invention relates to an electrophotographic copying apparatus, and more particularly to an electrophotographic copying apparatus which permits the making of a plurality of copies from one latent electrostatic image.

In general, the electrophotographic copying method employing a visible image transfer, is known using a series of steps consisting of the sensitizing of a photoconductor by electrical charging, the exposing of the photoconductor to form a latent electrostatic image, the developing of the latent image with a developer, the transferring of the developed visible image to a recording sheet or other materials, the electrical quenching of the photoconductor, and the cleaning of the photoconductor. Usually, this process is performed by rotating a drum-shaped or belt-shaped photoconductor so as to move the peripheral surface of the photoconductor in one direction.

In this specification, the electrophotographic copying method of the above-mentioned type is referred to as the copying method by single-copy process.

The latent electrostatic image formed on the photoconductor is stable for a comparatively long period of time in the dark. A copying method utilizing this characteristic of the latent image is known, which permits obtaining of copies from the same latent image by repeating both development of the latent image and the transferring of the developed image, once the latent image is formed. The copying method of this type is referred to as the copying method of multicopy process in this specification.

Since it is possible to adopt selectively both the copying method by single-copy process and the copying method by multi-copy process in the same copying apparatus by changing the control system of the copying apparatus, an electrophotographic copying machine, which permits selection of both the copying methods, has already been known.

The advantage of the copying method by multi-copy process is that since a plurality of the same copies can be obtained by a single exposure, and accordingly, since the number of cleanings can be reduced, the power consumption can be reduced. Furthermore, since from the second copy on, development and image transfer can be performed by use of the already formed same latent image, the copying time can be shortened significantly.

Naturally, an unlimited number of copies cannot be obtained from the same latent electrostatic image. With the increase in the number of repeated uses of the latent image, the image quality obtained is lowered. At the present technique level, approximately 30 copies from the same latent electrostatic image are practically usable in the case of line copying, and in the case of large, solid-image area copying, approximately 15 copies are practically usable.

In the case of the line copy work, for example, when 50 copies are required from the same original, they can be obtained in the following manner using the copying method by multi-copy process. First, the counter for use in multicopy is set for the maximum 30 copies, and initially 30 copies are made. Then the above-mentioned counter is set for 20 copies, and the remaining 20 copies are made.

However, in the case where all of these copies are to be used commercially, all the copies do not have a sufficient copy quality to be acceptable as a commercial product.

Out of 30 copies obtained by the multi-copy process from the same electrostatic image, if 10 copies have a sufficient image quality to qualify as a product to be commercialized, and 50 copies having such image quality are required from the same original, the multi-copy process has to be repeated five times by setting the copy counter for 10 copies each time when the conventional copying apparatus is utilized.

Furthermore, as shown in FIG. 4. when 10 copies can be obtained from the same latent image, but 12 copies from the same original are required, the latent image is formed at the first copy and at the tenth copy. However, the electric potential of a latent image is decreased in proportion to the number of repeated uses of the latent image. Therefore, the image density and resolution of the teeth copy is significantly lower than those of the first copy and the eleventh copy since with the increase of the number of repeated uses of the latent electrostatic image, the image quality of the copies is successively lowered. Also, the quality of the copies becomes uneven.

Furthermore, when the original is replaced with a subsequent original after the formation of the last latent image, the smaller in number the copies to be made after the final formation of the same latent image, the less the time allowed for replacing the subsequent original before the end of copying of the prior original, so the more the total copying time, causing a waste of time.

SUMMARY OF THE INVENTION

It is therefore an object of this invention to provide an improved electrophotographic copying apparatus which permits automatic copying of a desired number of copies from the same original by setting the desired number of repeated uses of the same latent electrostatic image on the machine.

Another object of this invention is to obviate the lowering and unevenness of the image quality of the copies.

A further object of this invention is to allow sufficient time to replace originals before the cessation or the prior copying so that the total copying time is shortened by removing any waste of time between successive original copying.

In one embodiment according to the present invention, first control means for setting selectively the number of copies to be made from the same latent image, and second control means for setting selectively the number of copies to be obtained from the same original document are provided.

After the first copy is made, the machine latent image formation apparatus and cleaning apparatus are made inoperative by the first control means. Under this condition, copying is continued until the number of copies from the same latent image amounts to the number set by the first means, and thereafter, the latent image formation apparatus and cleaning apparatus are actuated by the second control means so that the repeatedly used latent image is removed and the photoconductor is cleaned, and another latent image is formed from the same original.

The above-mentioned copying cycle accomplished by the first and second control means is continued until the number of copies amounts to the number set on the second control means.

In another embodiment according to the present invention, the timing of the formation of respective same latent images is controlled in accordance with the total number of copies to be made from the same original document so that the number of repeated uses of the respective same latent images is made approximately equal. Also in this embodiment, a signal indicating the timing for the exchange of each original is generated at the final formation of the same electrostatic image.

DETAILED DESCRIPTION OF THE PREFERRED EMBODIMENTS

Figure 1:
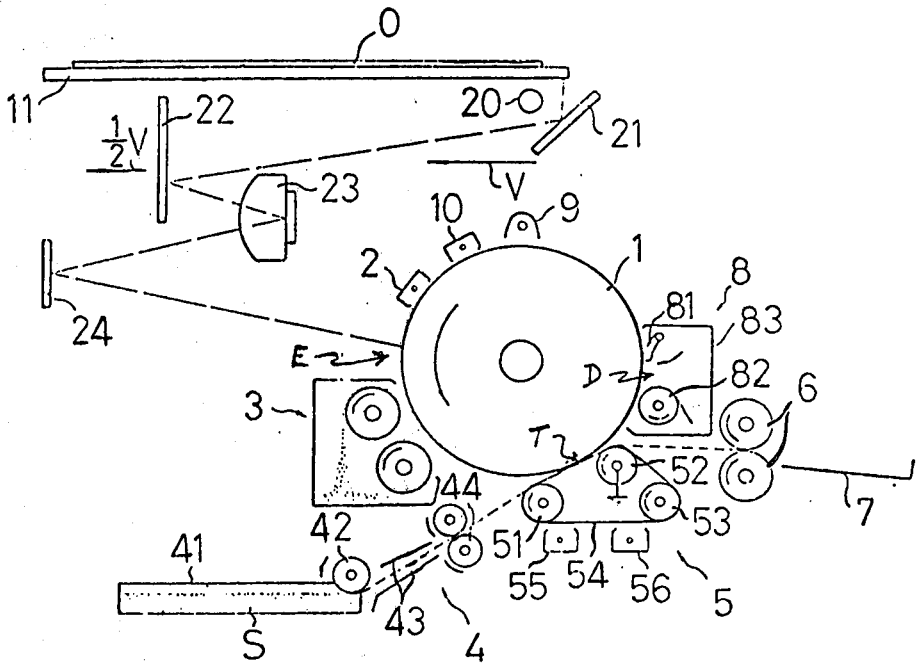
FIG. 1 is a schematic sectional view of the main portion of an electrophotographic copying apparatus to which the present invention can be applied.

FIG. 1 shows the main portion of an electrophotographic copying apparatus to which the present invention can be applied. In the figure, numeral 1 indicates a photoconductor. The photoconductor 1 is drum-shaped. It is rotatably mounted for travel in the direction of the arrow. In accordance with the single-copy process, around the drum there are provided charger 2, exposure station 3, development apparatus 3, paper feeding apparatus 4, image transfer apparatus 5, image fixing apparatus 6, cleaning apparatus 8, quenching lamp 9, and quenching charger 10.

The single-copy process in this copying apparatus is performed in the following manner. An original document O to be copied is placed on contact glass 11. When the photoconductor 1 begins to rotate in the direction of the arrow, the charger 2 sprays electrical charges over the photoconductor 1; thus the surface of the photoconductor is uniformly charged. At the same time, an exposure lamp 20 is lit, and the original disposed near the exposure lamp is subjected to a slit-like illumination by the lamp. When the charged peripheral surface area of the photoconductor reaches the exposure station E, a mirror 21 begins to move, integrally with the lamp 20, in the direction of the arrow at speed V, namely at the same speed as the peripheral speed of the photoconductor 1. Thus the original document is scanned by the slit exposure of the exposure lamp. Also at the same time, a mirror 22 is moved in the direction of the arrow at speed $\frac{1}{2}$ V so that the optical path of the exposure light from the illumination station to the exposure station E through the mirrors 21, 22, in-mirror-lens 23, and mirror 24 is kept constant.

Thus, an image identical with the image of the original document O in the illumination station is formed on the exposure station E by the in-mirror-lens 23. With the rotation of the photoconductor 1, a latent electrostatic image is formed corresponding to the image of the original document, on the peripheral surface of the photoconductor 1.

The thus formed latent electrostatic image is developed by the development apparatus 3 and made visible. In this embodiment, a magnetic brush development is adopted. However, any type of development method, including a wet type development method, can be employed as well in the embodiment according to the present invention.

In the present embodiment, in order that an image with high image density can be obtained more easily when using the multi-copy process, a multi-step magnetic brush development method is preferred, in which the latent electrostatic image is in contact with the developer for a comparatively long time, and which also permits prevention of the leakage of charge from the latent electrostatic image.

Recording sheets S, to which the developed visible image is to be transferred, are stacked in a cassette 41 of the paper feeding apparatus 4.

Timed to the advancement of the visible image, each sheet is fed to the image transfer station T by the sheet feeding apparatus 4. More specifically, the recording sheet S, fed by a feeding roller 42, is guided by a guide 43, and is then transported to the image transfer station by the feeding rollers 44.

The image transfer apparatus 5 is constituted by a belt 54, which is stretched over rollers 51, 52, 53, and a charger 55, and quenching charger 56. The belt 54 consists of a conductive belt whose surface is coated with an insulating layer. A part of the surface of the belt is in contact with the peripheral surface of the photoconductor 1. By rotation of the rollers 51, 52, 53 in the direction of the arrows, the belt is moved at the same speed as the peripheral speed of the photoconductor 1 so that the surface of the belt is charged uniformly by the charger 55. The recording sheet S, transported to the image transfer station T, namely, the region of contact between the belt 54 and the photoconductor 1, is placed over the developed visible image on the photoconductor 1, and the image is transferred to the recording sheet S by electrical attraction of the charges sprayed over the surface of the belt 54. This image transfer method can prevent leakage of the charge from the latent electrostatic image during the process of image transfer. Therefore this method permits extending of the life of the latent image.

The quenching charger 56 is provided to remove the electric charge on the belt 54 and to prevent the surface potential of the belt 54 from becoming higher than the required surface potential and also to permit uniform charging of the belt 54. In practice, the surface potential of the belt 54 has to be controlled so as not to damage the latent electrostatic images at the time of image transfer.

After the transferred visible image is fixed by apparatus 6, the image bearing recording sheet S is transported onto a receiving tray 7. After the transferring of the developed visible image, residual developer D on the photoconductor 1 is removed from the peripheral surface of the photoconductor 1 by the cleaning apparatus 8. More specifically, the residual developer is removed from the peripheral surface of the photoconductor by a blade 81, and the removed developer is caught by the peripheral surface of a roller 82 which is disposed in close proximity to the peripheral surface of the photoconductor, and is then recovered into a recovery container 83 with rotation of the roller 82 which bears the removed developer thereon.

The cleaning apparatus 8 is not operated while only the steps of development of a latent electrostatic image and transfer of the developed visible image are repeated in the multi-copy process. The unrecovered developer is used in the subsequent development process. In the meantime, the blade 81 is not in contact with the photoconductor 1. If the roller 82 is in contact with the photoconductor 1, the blade 81 and the roller 82 are released at the same time.

After the residual developer is removed, the electric charges remaining on the photoconductor 1 are dismissed by both quenching lamp 9 and quenching charger 10. As a matter of course, these quenching devices are not operated while latent electrostatic images are used repeatedly in the multi-copy process.

The above-mentioned single-copy process is constituted by the steps of sensitizing the photoconductor by electrical charging, exposing the photoconductor to form a latent electrostatic image, developing the latent image with a developer, transferring the developed image to the recording sheet or other materials, fixing the image, cleaning the photoconductor, and also electrically quenching the photoconductor.

Hereinafter, the term "cleaning process" includes both the cleaning of the photoconductor and the electrical quenching of the photoconductor.

Figure 2:
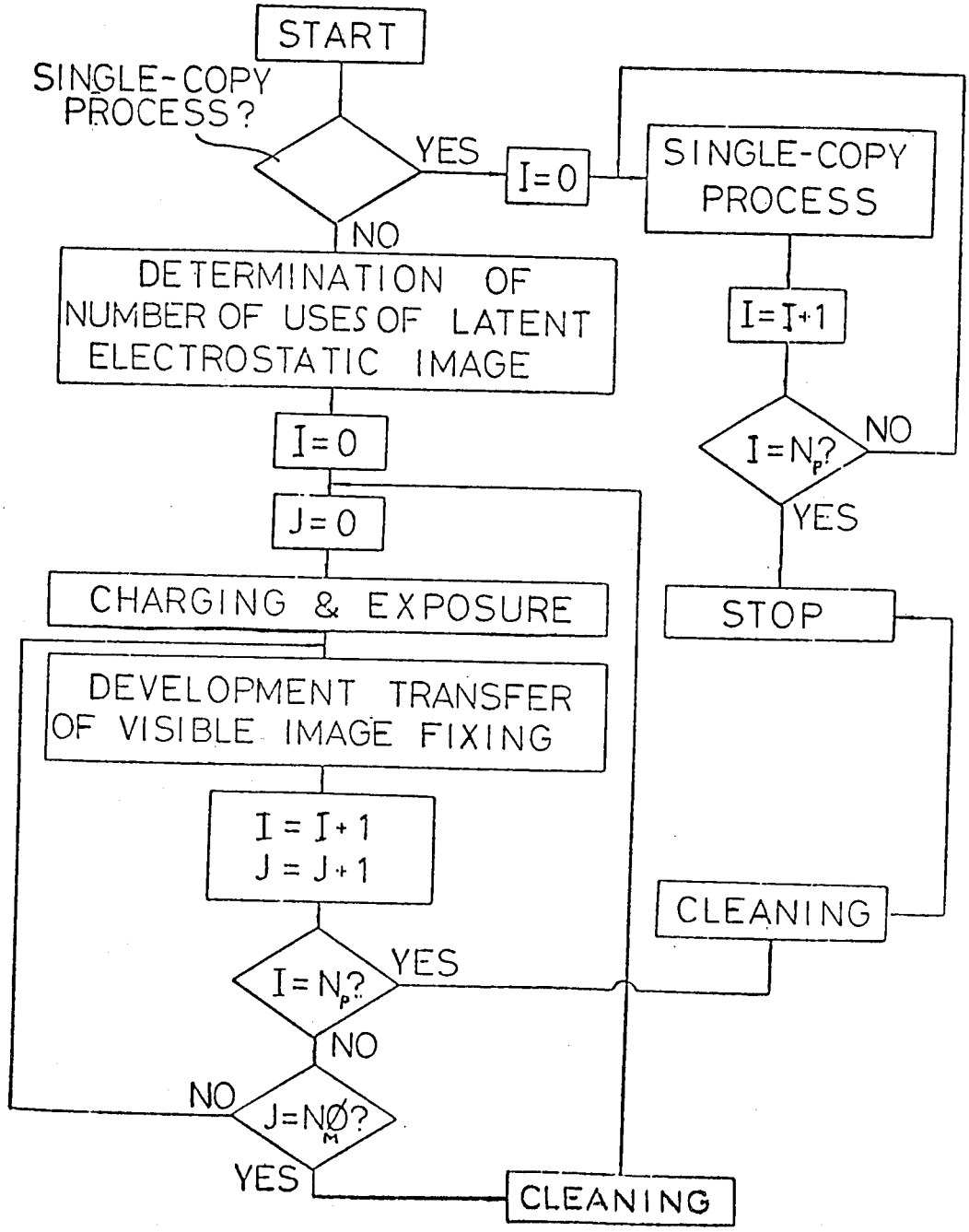
FIG. 2 is a flow chart showing the electrophotographic copying process of an embodiment according to the invention.
Figure 3:
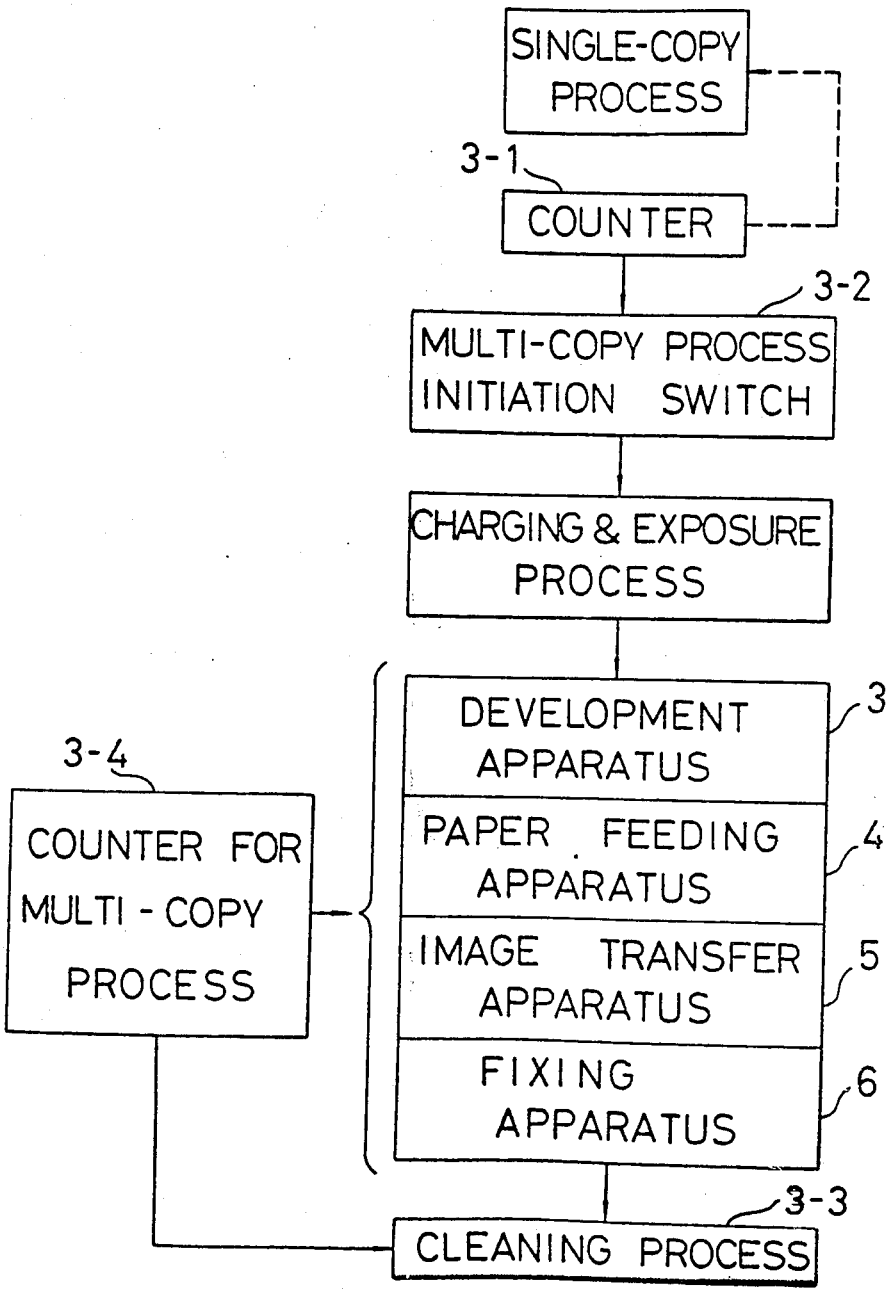
FIG. 3 is a block diagram showing one example of the control sequence of an electrophotographic copying apparatus according to the invention.
Figure 4:
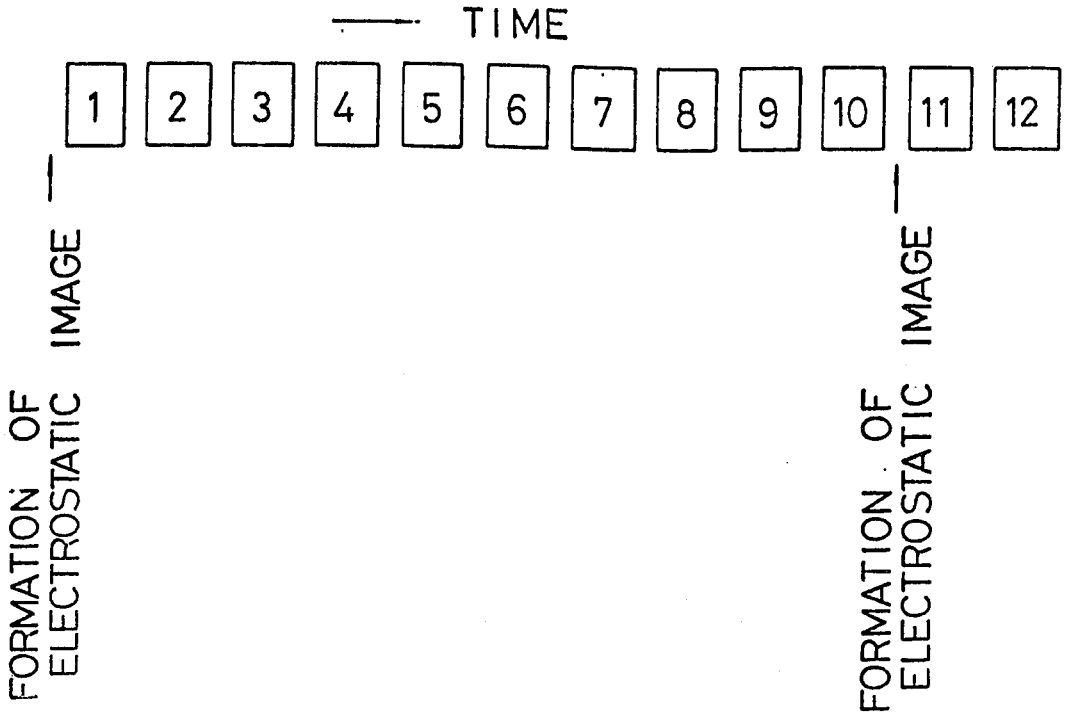
FIG. 4 is a diagram showing the timing of the formation of the same latent image in the multi-copy process of the conventional electrophotographic copying apparatus.

Now referring to the flow chart in FIG. 2 and the block diagram in FIG. 3, a multi-copy process utilizing the apparatus capable of both copying methods according to the present invention id described in the following paragraphs.

The maximum reusable number $N_{max}$ of one latent electrostatic image in the multi-copy process is approximately 30 as mentioned before, but usually the selected number of copies to be made for the same electrostatic image, $N_M$, will be less.

In order to conduct the multi-copy process, firstly, the control system of the apparatus has to be switched to select the multi-copy process. After the control system is switched to the multi-copy process, the total number of copies $N_p$ to be made from a single original is set on a counter 3-1 of FIG. 3, which shows the control system of the apparatus according to the invention. In accordance with the copy quality desired, the number $N_M$ of the repeated uses of the same latent electrostatic image is determined, and this number is set on a constant 3-4 for the multi-copy process in FIG. 3. When the number $N_M$ is set at 1, the apparatus is automatically set for the single-copy process.

When $N_M > 1$, then by a signal from the counter 3-1, a start switch 3-2 of the sequence circuit for multi-copy process is turned on, whereby the multi-copy process is started. First of all, the counter 3-1 is automatically set to begin counting from copy number zero (0), and the counter 3-4 is also automatically set to count from number zero (0). In FIG. 2, I and J are the count variables for the counters 3-1, 3-4, respectively. Then a latent electrostatic image is formed on the photoconductor 1, as in the above-mentioned single-copy process, by the exposure optical system consisting of the charger 2, the exposure lamp 20, the mirrors 21, 22, 23, 24 and in-mirror-lens 23.

Following the formation of the latent electrostatic image, the latent image is converted to a visible image by the development apparatus. The image transfer apparatus 5 transfers the visible image to the recording sheet S which is fed by the sheet feeding apparatus 4. After the image is fixed on the sheet, the first copy is transported onto the receiving tray 7. At this time, the counter 3-1 counts the first copy $I=1$ and the counter 3-4 counts the first multi-copy process $J=1$.

After the charging and exposure, the operation sequence of this apparatus is controlled by the counter 3-4, and by utilizing the already formed latent electrostatic image, a series of processes of development, transfer, and fixing, is repeated until the number of copies amounts to the number which has already been set on the counter 3-4, $J=N_M$. During this operation the charging and exposure systems are held inoperative. The releasing of the setting of the counter 3-4 is described later.

With each copy, one is added to the respective values of the variables I, J of the counters 3-1, 3-4.

Thus when the present number of copies $N_M$ are obtained, the number of uses of the same latent electrostatic image, which has been set on the counter 3-4 is fulfilled and the difference between the number which has been set on the counter 3-4 and the number counted by the counter 3-4 becomes zero, whereby a signal is generated so as to clean the photoconductor by the cleaning process apparatus 3-3 in accordance with the sequence of the multi-copy process and the count number of the counter 3-4 is reset to 0. At this stage, the sequence circuit for the multi-copy process is shut off. However, when the control system of this apparatus is switched to the multi-copy process, the performance of the counter 3-1 is preset so as to continue to generate a signal to turn on the start switch 3-2 of the sequence circuit for the multi-copy process until $I=N_p$, whereby the multi-copy process is immediately started again. When the first copy is obtained by the resumed multi-copy process, the counter 3-4 counts one (1) again, while the counter 3-1 counts $I+1$.

Thus when the total number of copies amounts to the desired $N_p$ sheets of copies and the counter 3-1 counts $I=N_p$, the difference between the number of copies, $N_p$, which has been set on the counter 3-1, and the number counted by the counter 3-1 becomes zero (0), whereby the counter 3-1 generates a signal to terminate copying irrespective of the number J counted by the counter 3-4, so that the number of repeated uses of the latent electrostatic image $N_M$, which has been set by the counter 3-4 for use in the multi-copy process, is released and the control performance of the counter 3-4 is stopped. Thereupon, the cleaning apparatus 8 for the photoconductor, the quenching lamp 9, and the quenching charger 10 are caused to operate by the control of the cleaning process apparatus 3-3. Thus the operation of the present copying apparatus is stopped after the photoconductor 1 is cleaned.

In the case where the control system of this copying apparatus is switched to the single-copy process, the counter 3-1 controls the single-copy process. The manner of the control by the counter 3-1 is exactly the same as the performance of the counter employed in the conventional copying apparatus exclusively utilizing the single-copy process.

Figure 5:
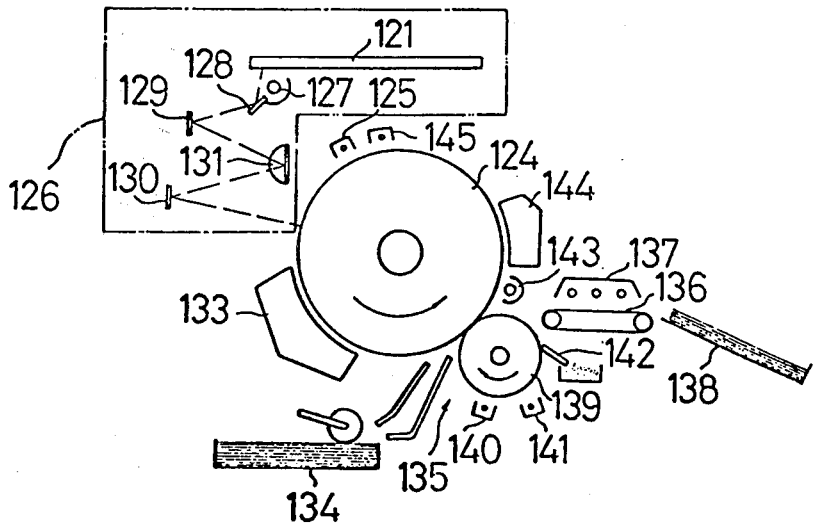
FIG. 5 is a schematic sectional view of another embodiment according to the invention.
Figure 6:
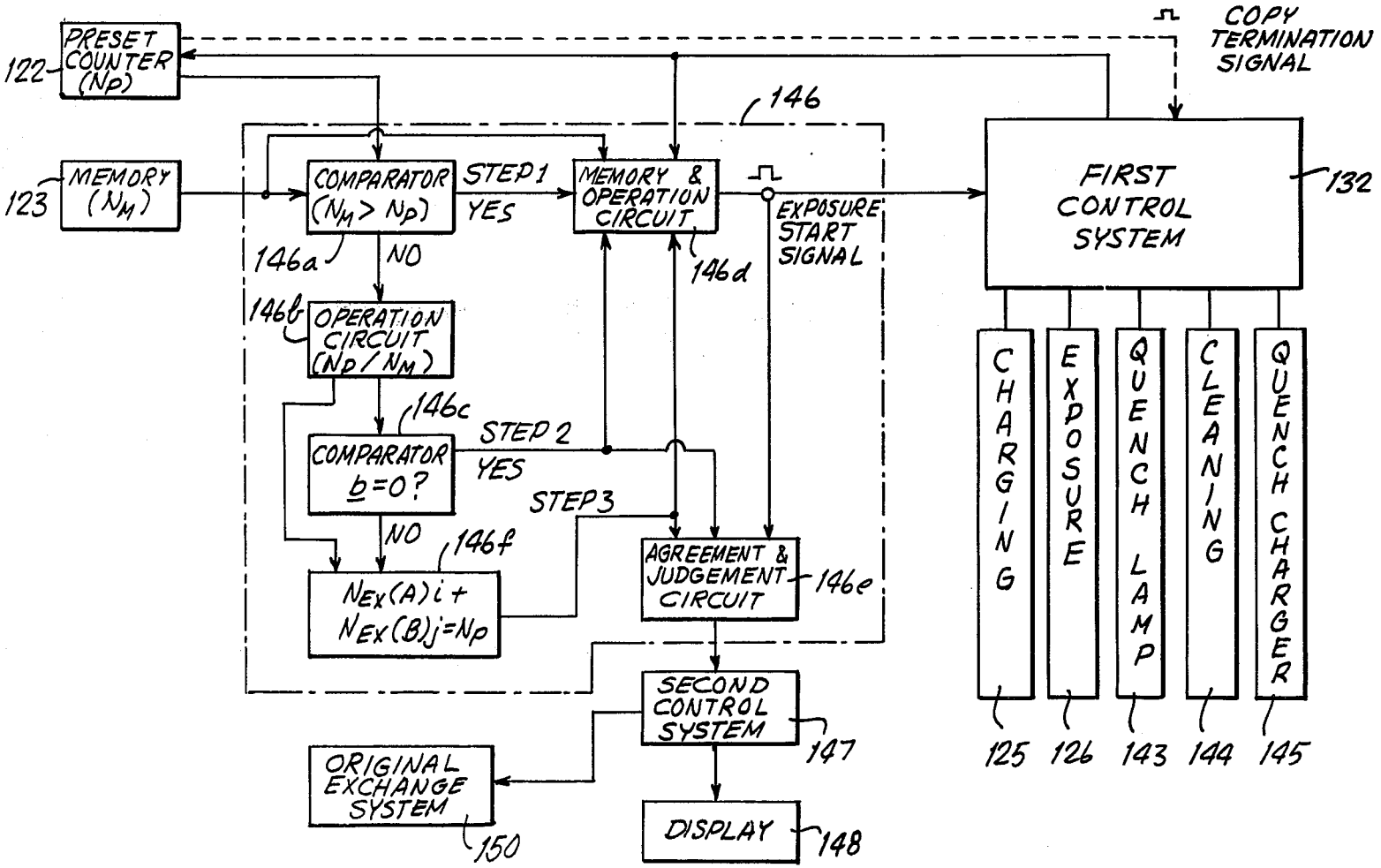
FIG. 6 is a block diagram showing the components of the control system applied to the embodiment in FIG. 5.
Figure 7:
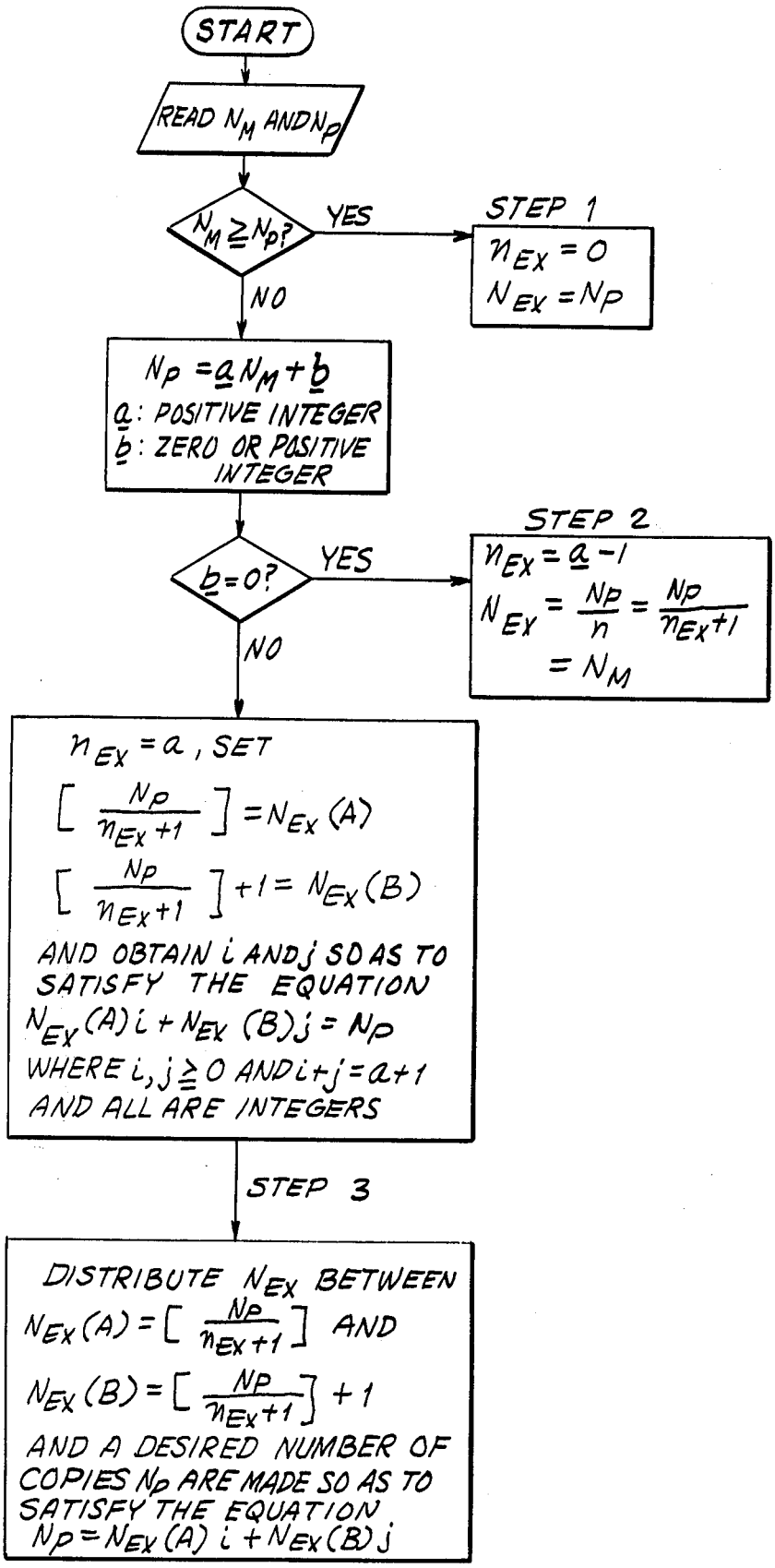
FIG. 7 is a flow chart showing the steps of the multi-copy process of the embodiment in FIG. 5.

FIGS. 5, 6 and 7 show another embodiment of the copying apparatus according to the invention. As shown in FIGS. 5 and 6, an original document is placed on document platen 121 and the total number of copies to be made, $N_p$, is set on a preset counter 122. Memory 123 stores the selected number of repetitive uses of a particular latent electrostatic image, $N_M$. When the print switch is pushed, photoconductor 124 is driven to rotate. The photoconductor 124 is uniformly charged by charging apparatus 125 during the first rotation of the photoconductor. Then the photoconductor 124 is exposed to a light pattern from the original by exposure apparatus 126 so that a latent electrostatic image is formed on the photoconductor. The exposure apparatus is constituted of a slit exposure apparatus employing lamp 127, mirrors 128, 129, 130, and in-mirror-lens 131. When this copying apparatus is operated, the lamp 127 is lit by first control system 132, and the original placed on the document platen 121 is illuminated by the lamp 127 and at the same time, the document platen 121 is driven so that the image of the original is projected to the photoconductor 124 by slit exposure through the mirrors 128, 129, 130 and the in-mirror-lens 131. Thus a latent electrostatic image is formed on the photoconductor 124. The thus-formed latent image is developed by development apparatus 133.

Image transfer apparatus 134 transfers the developed image to paper fed by paper feeding apparatus 134. After image transfer, paper carriage apparatus 136 transports the image bearing paper to fixing apparatus 137 where the image is fixed, and the paper is carried as a finished copy onto receiving tray 138. The image transfer apparatus 135 is provided with roller 139, by which transfer paper is brought into pressure contact with the photoconductor 124 so that the toner image is transferred to the paper. On the front side of the image transfer position, the surface of the roller 139 is charged up to a predetermined potential of the same polarity as that of the surface potential of the photoconductor 124 by charging apparatus 140. Also on the back side of the image transfer position, electric charges on the surface of the roller 139 are removed by corona charger 141 and at the same time, the roller is cleaned by cleaning apparatus 142.

Furthermore, quenching lamp 143, cleaning apparatus 144 for removing residual toner, and corona charger 145 for quenching electric charges on the photoconductor are provided for cleaning the photoconductor 124. However, unlike the preceding components, these cleaning apparatus are not actuated by the first control system 132 during the initial copying operation.

From the second rotation of the photoconductor 124 on, the latent electrostatic image formation apparatus, consisting of charging apparatus 125 and exposure apparatus 126, is made inoperative by the first control system 132 so that no latent image is formed on the photoconductor 124, but copying is performed, utilizing the same latent image formed by the first rotation of the photoconductor 124. In other words, with each rotation of the photoconductor 124, the latent electrostatic image on the photoconductor 124 is developed by the development apparatus 133, the developed image is transferred by the image transfer apparatus 135 to a transfer paper which is fed by the paper feeding apparatus 134, and then the transferred image is fixed by the fixing apparatus 137 and the transfer paper having the fixed image thereon is discharged onto the receiving tray 138. The preset counter 122 counts the number of copies as each copy is being made, and when the total number of copies amounts to a perset copy number $N_p$, a signal is transmitted to the first control system 132 so that the copying operation is terminated.

Referring to the flow chart in FIG. 7 and the block diagram in FIG. 6, the operation of a multi-copy process using the apparatus of this embodiment of the present invention will be described in detail.

Initially, the number of usable copies $N_M$ which can be made from the same latent electrostatic image formed on the photoconductor, is set in memory 123, and the total number of copies $N_p$, to be made of a given original, is set in counter 122. The print switch is then activated. At the start of the run the preset values $N_M$ and $N_p$ are read and compared in comparator device 146 to determine whether or not $N_p$ is greater than $N_M$, that is, the operation $N_M \geqq N_p$? is carried out by comparator circuit 146*a*.

If the answer is yes (positive), then all of the desired copies $N_p$ can be produced from a single electrostatic image, so that only one exposure of the original is necessary. Accordingly, the number of copies $N_{EX}$, actually produced from a latent electrostatic image obtained by one exposure, will in this case be the total to be produced, that is, $N_{EX}=N_p$ and the number $n_{EX}$ of additional exposures of the original, after the initial exposure to produce the first image, is zero. Thereupon, when $n_{EX}=0$ and $N_{EX}=N_p$, comparator circuit 146*a* will supply an output to memory and operation circuit 146*d* so that Step 1, wherein all the desired copies $N_p$ are produced, is performed by the machine in a single exposure process.

If upon comparison by circuit 146*a* the result of $N_M \geqq N_p$? is no (negative), that is $N_M$ is less than $N_p$, a further evaluation is carried out in accordance with the relationship:

$$N_p = a \cdot N_M + b \tag{1}$$

where a is a positive integer and b is zero or a positive integer. This evaluation is performed by operation circuit 146*b*, which divides $N_p$ by $N_M$, and comparator circuit 146*c*, which evaluates b=0?. It will be seen that if $N_p$ is an even multiple of $N_M$, then the evaluation b=0? will be yes (positive), but if not, b will be some value less then $N_M$.

When the answer is yes (positive), that is, b=0, the total number n of original exposures or formations of latent images will be equal to a, that is $n=n_{EX}+1=a$ and $N_p/N_M$ will equal a. Accordingly, the number of copies $N_{EX}$ produced from each electrostatic image will be:

$$N_{EX}=N_p/n=N_p/(n_{EX}+1)=N_p/a$$

so that in this instance $N_{EX}$ will also be equal to $N_M$ with $n_{EX}=a-1$. Thereupon, comparator circuit 146*c* will supply an output in Step 2 to memory and operation circuit 146*d* to perform the programmed multi-copy process using a exposures of the original. Thus, circuit 146*d* will produce an exposure start signal each time $N_M$ copies are produced until $N_p$ copies are completed. The output from comparator circuit 146*c* is also supplied to agreement and judgement circuit 146*e* which compares it with the number of exposure start signals produced to provide an indication when the final signal is supplied.

On the other hand, if the answer to $b=0$? is no (negative), so that $b\neq 0$, the total number of exposures n is $a+1$, since of the $N_p$ copies to be made, $a \cdot N_M$ copies are made by making an exposure a times and the rest of the copies to be made, that is, b copies, can be made with one exposure. Thus, $n=a+1$, and since $n=n_{EX}+1$, $n_{EX}=a$ in this case. Accordingly, in this instance in order to make $N_p$ copies, $N_{EX}$, which is the number of copies actually made with a single image, cannot be set at one value as in the case where $b=0$, but rather it must be set at two different values $N_{EX}(A)$ and $N_{EX}(B)$. Furthermore, in order to obtain $N_p$ copies as uniform as possible in image quality it is desirable that the values of $N_{EX}(A)$ and $N_{EX}(B)$ be as close as possible, and most desirable that they differ only by 1. Therefore, $N_p$ copies should be distributed between $N_{EX}(A)i$ and $N_{EX}(B)j$, such that $N_p=N_{EX}(A)i+N_{EX}(B)j$, where i and j are integers and $i+j=a+1$. This desired condition can be satisfied by setting:

$$N_{EX}(A)=N_p/(n_{EX}+1) \quad (2)$$

and $$N_{EX}(B)=N_p/(n_{EX}+1)+1 \quad (2)$$

This evaluation is carried out in computing circuit 146f which in Step 3 supplies an output to memory and operation circuit 146d to perform the programmed process according to the present values and relationships. This output is also supplied to agreement and judgement circuit 146c.

To better illustrate the circuit response to these values and relationships, consider the following specific examples:

EXAMPLE 1

In the case where $N_p$ is not more than $N_M$ (in the flow chart, $N_M \geqq N_p$?→Yes), for instance if $N_M=10$ and $N_p=8$, one exposure is enough. Accordingly $n_{EX}=0$ and $N_{EX}=n_p=8$. Step 1 will be carried out wherein one exposed start signal is produced by circuit 146d and first control system 132 will cease the copying operation upon receipt of a termination signal from counter 122 with $N_p$, that is 8, copies are counted.

EXAMPLE 2

In the case where $N_p$ is greater than $N_M$ (in the flow chart, $N_M \geqq N_p$?→No) and $b=0$, for instance, if $N_M=10$ and $N_p=30$, then $$N_p N_M=30/10=3$$

Hence, $N_p=a \cdot N_M+b=3\times 10+0$ $n=a=n_{EX}+1=3$ $N_{EX}=N_p/n=N_p/(n_{EX}+1)=30/3=10=N_M$ Step 2 will be carried out wherein in addition to the initial exposure start signal, circuit 146d will produce two additional exposure signals, each after 10 copies have been completed from the preceding latent image so that the total number of copies will be 30 before copying ceases.

EXAMPLE 3

In the case where $N_p$ is greater than $N_M$ (in the flow chart, $N_M \geqq N_p$?→No) and $b\neq 0$, for instance, if $N_M=10$, and $N_p=73$, then $$N_p N_M=73/10=7=3/10$$

$$N_p=a \cdot N_M+b=7\times 10+3.$$

Therefore, $a=7$ and $b=3$. Further, since in this case $a=n_{EX}$, $n_{EX}=7$ and $n=n_{EX}+1+7+1=8$.

It will be seen that, ordinarily 73 copies could be made by making 10 copies from one latent electrostatic image and repeating that copying step 7 times, and then making 3 copies by one additional exposure. However, in the present invention, in order to obtain 73 copies with more uniform image quality, reference is made to equations (2) and $N_{EX}(A)$ and $N_{EX}(B)$ are calculated as follows:

$$N_{EX}(A)=\left(\frac{N_p}{n_{EX}+1}\right)=\left(\frac{73}{7+1}\right)=9$$

$$N_{EX}(B)=\left(\frac{N_p}{n_{EX}+1}\right)+1=\left(\frac{73}{7+1}\right)+1=9+1=10$$

and, $N_{EX}(A)i+N_{EX}(B)u=N_p$, so that $9i+10j=73$ but, $i+j=a+1=8$

From the latter relationships, $i=7$ and $j=1$.

Therefore, in order to obtain the greatest uniformity of copies, 9 copies should be made from the same electrostatic image and 7 such images should be made, while 10 copies should be made from a remaining electrostatic image, so that 8 exposures or electrostatic images would be made in total. The output from computing circuit 146f in Step 3 will accordingly signal memory and operation circuit 146d to operate in this manner.

EXAMPLE 4

As a general example, consider that $N_M=10$ and $N_p=25$. Then $N_p/N_M=25/10=2+5/10$, and $N_p=a \cdot N_M+b=2\times 10+5$. This case belongs to the pattern of Example 3, so that $N_{EX}(A)=25/(2+1)=8$ and $N_{EX}(B)=8+1=9$ and $a=2$. Therefore, $8i+9J=25$ and $i+j=3$, so that $i=2$ and $j=1$. Step 3 will be carried out wherein 8 copies will be made from the same electrostatic image, and 2 such images will be made, while 9 copies are made from a remaining image. Three exposures are made in total, i.e., $n=n_{EX}+1=a+1=2+1=3$.

As previously noted, the agreement and judgement circuit 146e receives signals from comparator 146c and computing circuit 146f indicative of the number of exposures to be carried out in Step 2 or Step 3 and compares this number with the exposure start signals output by memory and operation circuit 146d. When the numbers coincide circuit 146e provides a signal to second control system 147 to initiate its operation and in turn light display apparatus 148. Thus, after the formation of the last latent electrostatic image from a single original, display 148 will be lighted to provide an indication that an exchange of originals may begin. Meanwhile, the remaining copies are being produced from the last latent image. Second control system 147 may also provide a signal to an automatic original feeding apparatus 150 to cause it to carry out the original exchanging operation. Since in this embodiment the number of copies to be made from each latent electrostatic image is adjusted, under the control of the comparator device 146, to be approximately equal, the number of copies to be made after the formation of the last latent image will not ordinarily be small in number so that sufficient time will be afforded for exchanging the originals before copying of the previous original ceases and copying of the subsequent original is ready to begin. Thus, little time is wasted in the changeover process and consequently the total time required will be shortened.

Appropriate components and circuits for the counters, memory devices, and other operational circuits in the system may be readily selected and assembled by those skilled in the art given the described combination of operations.

In summary then, upon the initiation of copying of an original by the actuation of a print switch, the first control system 132 will operate the charging apparatus 125 and the exposure apparatus 126 to produce a latent electrostatic image in response to an exposure start signal from the comparator device 146. Following the formation of the first latent image, control system 132 will maintain charging apparatus 125, exposure apparatus 126, quenching lamp 143, cleaning apparatus 144, quenching corona charger 145, and ancilliary components inoperative while copies are being made from the image. Copies will be produced from the same electrostatic latent image until a subsequent exposure start signal is provided from comparator device 146 to cause first control system 132 to operate the quenching and cleaning units 143-145 and units 125, 126 to produce another latent image from the same original. Copying will thus continue until the predetermined number $N_p$ of copies set on the preset counter 122 are made, whereupon the counter 122 sends a copy termination signal to first control system 132 which then actuates the quenching lamp 143, the cleaning apparatus 144, and the quenching corona charger 146 to clean the photoconductor 124, and the copying operation is terminated. Upon the production of the last latent tlectrostatic image from the same original an output signal is provided from comparator 146 to the second control system 147 which lights display apparatus 148 so that an indication is provided that it is time to exchange the originals. Second control system 147 may also at this time actuate an automatic original feeding and exchanging apparatus 150. Counter 122 and memory 123 may then be reset manually or automatically and copying of the subsequent original will be carried out in like manner until all of the copies from all of the originals are completed, at which time the machine may be automatically turned off by a means on which the total number of originals to be copied has been set.

We claim:

1. In an electrophotographic copying apparatus of the type having at least latent electrostatic image formation means for forming a latent electrostatic image by charging a photoconductor and exposing said photoconductor to an image of an original;

development means for developing an electrostatic image with a developer;

image transfer means for transferring a developed image to a recording medium; and cleaning means for cleaning said photoconductor; wherein a plurality of copies can be made from the same electrostatic image formed by said latent electrostatic image formation means, the improvement comprising:

first means for setting selectively the number of copies to be obtained from the same latent image, wherein a maximum number of copies is practically obtainable from the same latent image;

second means for setting selectively the number of copies to be obtained from the same original;

first control means for making said latent electrostatic image formation means inoperative during the period of time following the formation of the first copy until the formation of the final copy from the same latent image as set by said first means; and second control means for actuating said cleaning means when the final copy from the same latent image is formed as set by said first means and when the number of copies set by said second means have been are obtained from the same original.

2. An apparatus as in claim 1 wherein said first and second means comprise means for counting the number of copies made.

3. An apparatus as in claim 1 wherein said second control means comprises means for generating an operational signal when the number of copies made equals the number of copies set by said first means.

4. An apparatus as in claim 1 wherein said second control means comprises means for generating an operational signal when the number of copies made equals the number of copies set by said second means.

5. An apparatus as in claim 1 wherein said image transfer means comprises:

a conductive belt having an insulating layer thereon;

charging means for charging uniformly the insulated surface of said belt; and quenching charger means for removing electric charges on the surface of said belt.

6. In an electrophotographic copying apparatus of the type having at least latent electrostatic image formation means for forming a latent electrostatic image by charging a photoconductor and exposing said photoconductor to an image of an original;

development means for developing the latent electrostatic image with a developer;

image transfer means for transferring a developed image to a recording medium; and cleaning means for cleaning said photoconductor; wherein a plurality of copies can be made from the same latent electrostatic image formed by said latent electrostatic image formation means, the improvement comprising:

first means for setting selectively a maximum number of copies $N_M$ to be obtained from the same latent image within a number of copies practically obtainable from the same latent image, and producing a signal in accordance therewith;

second means for setting selectively the total number of copies $N_p$ to be obtained from the same original and producing a signal in accordance therewith;

first regulating means for making both said cleaning means and said latent electrostatic image formation means inoperative during the period of time from the formation of the first copy to the formation of the final copy from the same latent image in response to said signals produced by said first and second means and for generating an operational signal at the formation of the final copy from the same latent image; and second regulating means for actuating at least said cleaning means and said latent electrostatic image formation means, in response to each of said operational signals from said first regulating means, until the number of copies set by said second means are obtained from the original.

7. An apparatus as in claim 6 wherein said first regulating means comprises:

means for controlling the timing of the production of said operational signals; and comparator means for generating a control signal after comparison of said signals produced by said first and second means, which control signal actuates said controlling means such that the number of repeated uses of respective latent electrostatic images becomes approximately equal.

8. An apparatus as in claim 7 wherein said first regulating means further comprises means for generating an indicative signal upon the formation of the final electrostatic image to be obtained from a respective original to indicate the time for exchanging the original.

9. An apparatus as in claim 6 wherein said first regulating means comprises:

means for evaluating $N_M \geqq N_p$? and producing a positive or negative output; and exposure start signal producing means for generating a signal to actuate said latent electrostatic image formation means in response to a positive signal from said evaluating means.

10. An apparatus as in claim 9 wherein said first regulating means further comprises:

operation circuit means for evaluating $N_p/N_M$ in response to a negative signal from said evaluating means; and means for evaluating b=0?, where b is zero or a positive integer in the relationship $N_p = a \cdot N_M + b$ and where a is also a positive integer, in response to an output from said $N_p/N_M$ evaluating operation circuit means and for providing a signal to said exposure start signal producing means when b=0.

11. An apparatus as in claim 10 wherein said first regulating means further comprises computing circuit means, responsive to a signal from said b=0? evaluating means when $b \neq 0$, for evaluating $N_p = N_{EX} \cdot (A)i + N_{EX}(B)j$, where $N_{EX}(A) = N_p/(n_{EX}+1)$, $N_{EX}(B) = N_p/(n_{EX}+1)+1$ and $i+j=a+1$ are integers equal to or greater than zero, and $n_{EX}$ is the number of additional latent electrostatic images produced in addition to the original electrostatic image, and providing a signal to said exposure start signal producing means in accordance therewith.

12. Apparatus as in claim 11 wherein said first regulating means further comprises agreement and judgement circuit means for receiving said signals provided by said b=0? evaluating means and said computing circuit means and comparing these signals with the number of signals produced by said exposure start signal means and producing an indicative signal when said latter signals equal either of said former signals.

13. An apparatus as in claim 12 further comprising control means responsive to said indicative signal from said agreement and judgement circuit means for producing an output indicative of the formation of the last electrostatic image from the same original.

14. An apparatus as in claim 13 further comprising means responsive to the output from said control means for exchanging originals.

15. An apparatus as in claim 6 wherein said second means comprises means for counting the number of copies made and producing a stop signal when the number made equals $N_p$.

* * * * *